US005613845A

United States Patent [19]

Moon

[11] Patent Number: 5,613,845

[45] Date of Patent: Mar. 25, 1997

[54] CIRCULATING PUMP WITH A SUB-IMPELLER

[75] Inventor: Sung-Dai Moon, Kyeongsangbook-Do, Rep. of Korea

[73] Assignee: Daewoo Electronics Co., Ltd., Seoul, Rep. of Korea

[21] Appl. No.: 582,173

[22] Filed: Jan. 2, 1996

[30] Foreign Application Priority Data

Jun. 29, 1995 [KR] Rep. of Korea ..... 95-18216

[51] Int. Cl.[6] ..... F04D 29/08

[52] U.S. Cl. ..... 417/423.11; 415/170.1

[58] Field of Search ..... 417/423.11, 423.14; 415/171.1, 109, 170.1

[56] References Cited

U.S. PATENT DOCUMENTS

| | | | |
|---|---|---|---|
| 2,911,918 | 11/1959 | Reed | 417/423.11 X |
| 3,478,689 | 1/1969 | Ball | 417/423.11 X |
| 4,321,009 | 3/1982 | Fuji et al. | 415/170.1 |
| 5,156,535 | 10/1992 | Budris et al. | 417/423.11 X |
| 5,209,635 | 5/1993 | Stewart et al. | 415/170.1 X |

*Primary Examiner*—Richard E. Gluck
*Attorney, Agent, or Firm*—Beveridge, DeGrandi, Weilacher & Young, L.L.P.

[57] ABSTRACT

The present invention is relating to a circulating pump for pressurizing and circulating fluid in a system such as a boiler. An object of the present invention is to provide a circulating pump with a sub-impeller wherein a separate sub-impeller is provided below an impeller for moderating resistance occurring at the impeller due to pressure difference between an impeller chamber and an inside of the impeller during an operation of a pump so that power loss is prevented during a motor driving and a substance such as mud is prevented from entering a stator can. The circulating pump with a sub-impeller comprises a motor, an impeller and a pump housing. Below the impeller body, a sub-impeller with a plurality of radial baldes is provided. The sub-impeller forces out pressurized fluid that has flowed below the impeller back from below the impeller radially while rotating. According to this, pressure difference between an impeller chamber and an inside of the impeller which makes the impeller rise toward a suction ring is reduced. Thus, loss of power consumed for overcoming the pressure difference is also reduced.

1 Claim, 6 Drawing Sheets

CIRCULATING PUMP WITH A SUB-IMPELLER

BACKGROUND OF THE INVENTION

1. Field of the Invention

The present invention relates to a circulating pump for pressurizing and circulating fluid in a system such as a boiler, and more particularly to a circulating pump having a sub-impeller below an impeller of the pump to reduce resistance which occurs at the impeller due to pressure difference between an impeller chamber and an inside of the impeller during operation of the pump so that reduces power loss of a motor and prevents a substance such as mud from entering a stator can.

2. Description of the Prior Art

In general, a circulating pump is equipped in a system such as a boiler for circulating fluid under the action of pressure. Such a circulating pump conventionally comprises a motor acting as a power source for the circulating pump; an impeller which is combined with an output shaft of the motor, rotates together with the motor shaft according to the rotation of the motor shaft, and directly pressurizes fluid; and a pump housing which receives the impeller and includes an inlet passage for allowing fluid to flow into the impeller and an outlet passage for allowing fluid pressurized by the impeller to flow out of the impeller.

In such a prior-art circulating pump, fluid that has flowed into the pump housing through the inlet passage of the pump housing is pressurized by the impeller rotating according to the driving of the motor and flows out of the pump housing through the outlet passage thereof.

FIG. 1 shows a first embodiment for the prior-art circulating pump as described above.

According to FIG. 1, a prior-art circulating pump 1 comprises a motor 10, an impeller 20 and a pump housing 30.

Motor 10 includes a stator 11, a rotor 12 and a motor shaft 13. Stator 11 is fixed inside a motor housing 14. Rotor 12 is fixedly assembled with motor shaft 13 and separated from stator 11 by a stator can 15. One end of motor shaft 13 is supported by a lower bearing holder 16*a* and a lower bush bearing 17*a* at the inner bottom of motor housing 14. The other end of motor shaft 13 passes through a motor end shield 18 and is supported by an upper bearing holder 16*b* and an upper bush bearing 17*b* at motor end shield 18. Motor shaft 13 is supported by a trust bearing 17*c* which is to keep the motor shaft 13 from rising in ah axial direction of the motor shaft 13. Between lower bearing holder 16*a* and stator can 15, an O-ring 19*a* is provided to prevent fluid from leaking out. Likewise, an O-ring 19*b* prohibits the leakage of fluid between motor end shield 18 and stator can 15.

Impeller 20 includes an impeller body 21 and a shroud 22. Impeller body 21 and shroud 22 are, in general, connected to each other by an ultrasonic welding. Impeller body 21 is tightly fitted at the other end of motor shaft 13 by a bush 23. At the center of shroud 22 a through hole 24 is formed.

Pump housing 30 is disposed onto motor 10. Pump housing 30 includes an inlet passage 31 and an outlet passage 32 at its right and left sides respectively and an impeller chamber 33 at the center thereof. Impeller 20 is disposed inside impeller chamber 33. A suction ring 34 with a flange 34*a* and a cylinder 34*b* is provided at one end of inlet passage 31 of pump housing 30 just above shroud 22 of impeller 20. A fluid guide hole 35 is formed at the center of suction ring 34. Cylinder 34*b* of suction ring 34 protrudes with a predetermined length into through hole 24 formed at the center of shroud 22 of impeller 20. Between through hole 24 of shroud 22 and an outer wall of cylinder 34*b* of suction ring 34, and between an upper end of shroud 22 and a lower side of flange 34*a* of suction ring 34, some measure of clearance is provided. An O-ring 19*c* is provided to prevent fluid from leaking out between pump housing 30 and motor end shield 18.

According to the prior-art circulating pump 1 constructed as above, when an electric current is applied to stator 11 of motor 10, motor shaft 13 which is rotatably supported against motor housing 14 by means of lower bush bearing 17*a* and upper bush bearing 17*b* rotates by an electromagnetic force occurring between stator 11 and rotor 12. Accordingly, impeller 20 which is tightly fitted at one end of motor shaft 13 by means of bush 23 rotates. When impeller 20 rotates, the fluid that has flowed into impeller 20 through inlet passage 31 and suction ring 34 of pump housing 30 is pressurized by impeller 20 and is delivered into impeller chamber 33 and subsequently to outlet passage 32. At this time, some of the pressurized fluid in impeller chamber 33 flows Into stator can 15 through a gap between motor shaft 13 and upper bush bearing 17*b*. The fluid that has flowed into stator can 15 cools motor 10. The fluid which has entered stator can 15 reversely rises to flow into impeller chamber 33, and thereafter flows out of impeller chamber 33 together with other pressurized fluid therein through outlet passage 32.

However, according to the prior-art circulating pump constructed as above, when circulating pump 1 operates, fluid pressure in impeller chamber 33 is higher than that in inside of impeller 31, thus impeller 20 is forced toward suction ring 34. Since motor shaft 13 fixed at impeller 20 is supported by trust bearing 17*c* which is to keep the motor shaft 13 from rising in the axial direction, impeller 20 rotates against the force affecting suction ring 34 and therefore some of the rotating power of motor 10 is consumed in overcoming the resistance due to the pressure difference. It is a problem in that such a power loss would result in a pump efficiency to decline.

Also according to prior-art circulating pump 1 constructed as above, if a substance such as mud enters stator can 15 together with fluid through the gap between motor shaft 13 and upper bush bearing 17*b*, since the gap between motor shaft 13 and upper bush bearing 17*b* is quite narrow, the substance that has entered thereinto is hardly discharged to impeller chamber 33 again. That is, the substance remains in the stator can 15. At this time, if the substance gets in between motor shaft 13 and lower bush bearing 17*a*, a lubricative rotation of motor shaft 13 can be obstructed. Especially if pump 1 is not used for a long time, the substance will solidify so the rotation of motor shaft 13 could be impossible.

SUMMARY OF THE INVENTION

Therefore, it is an object of the present invention to provide a circulating pump with a sub-impeller wherein a separate sub-impeller is provided below an impeller of a circulating pump for moderating resistance occurring at the impeller due to pressure difference between an impeller chamber and an inside of the impeller during an operation of a pump so that power loss is prevented during a motor driving and foreign substances are prevented from entering into a stator can.

The object of the present invention is achieved by providing a circulating pump with a sub-impeller comprising a motor, an impeller and a pump housing wherein: the motor includes a motor housing, a stator fixed inside the motor housing, a stator can, a motor end shield and a plurality of sealing members for separating the stator from fluid, a rotor rotating-by means of an electromagnetic interaction with the stator when an electric current is applied to the stator, and a motor shaft integrally combined with the rotor, one end of the motor shaft being supported rotatably by a lower bush bearing at the inner bottom of the motor housing, the other end of the motor shaft being projected passing through a through hole formed in the motor end shield, and the motor shaft being supported rotatably by an upper bush bearing at the through hole of the motor end shield; the impeller includes an impeller body having a plurality of blades for pressurizing fluid, fixedly assembled with the other end of the motor shaft, and a sub-impeller with a plurality of blades radially disposed below the impeller body, and a shroud integrally fixed onto the impeller body, at the center of the shroud a through hole being formed for allowing fluid to flow; and the pump housing disposed onto the motor includes an inlet passage and an outlet passage provided at both sides thereof respectively, and an impeller chamber communicated with the inlet passage and the outlet passage at the center thereof.

According to the present invention constructed as above, when the motor drives and the impeller rotates, the sub-impeller disposed below the impeller rotates accordingly. The sub-impeller forces out pressurized fluid that has flowed below the impeller back from below the impeller radially while rotating. Accordingly, fluid pressure below the impeller becomes lower than that in the other portion of the impeller chamber, thus the pressure difference between the impeller chamber and the inside of the impeller which makes the impeller rise toward the suction ring is reduced.

At this time, a substance such as mud contained in fluid flowing below the impeller is forced out from below the impeller radially together with fluid by rotation of the sub-impeller. Especially if the substance contained in the flowing pressurized fluid is relatively heavier than the fluid, the substance contained in the fluid is affected by a more powerful centrifugal force than the fluid itself and therefore can be discharged further from the center of the impeller than the fluid.

Therefore, according to the circulating pump with a sub-impeller constructed as above, since pressure difference between the impeller chamber and the inside of the impeller is reduced by the rotation of the sub-impeller, power loss of the motor caused by the pressure difference can be reduced and accordingly the pump efficiency can be prevented from being lowered.

Also, according to the circulating pump with a sub-impeller constructed as above, since the rotation of the sub-impeller keeps a substance such as mud from entering the stator can through a gap between the motor shaft and the upper bush bearing, the substance that has entered the stator can can be prevented from letting a pump efficiency decline.

Also, the object of the present invention is achieved by providing a circulating pump with a sub-impeller comprising a motor, an impeller and a pump housing wherein: the motor includes a motor housing, a stator fixed inside the motor housing, a stator can, a motor end shield and a plurality of sealing members for separating the stator from fluid, a rotor rotating by means of an electromagnetic interaction with the stator when an electric current is applied to the stator, and a motor shaft integrally combined with the rotor, one end of the motor shaft being supported rotatably by a lower bush bearing at the inner bottom of the motor housing, the other end of the motor shaft being projected passing through a through hole formed in the motor end shield, and the motor shaft being supported rotatably by an upper bush bearing at the through hole of the motor end shield; the impeller includes an impeller body having a plurality of blades for pressurizing fluid, fixedly assembled with the other end of the motor shaft, and a sub-impeller with a plurality of blades radially disposed below the impeller body, and a shroud integrally fixed onto the impeller body, at the center of the shroud a through hole being formed for allowing fluid to flow and at the other end of the shroud an annular flange with a plurality of grooves being formed; and the pump housing includes a housing body disposed onto the motor and comprising an inlet passage and an outlet passage provided at both sides thereof respectively, at the center of the housing body the impeller being disposed and an impeller chamber communicated with the inlet passage and the outlet passage, and a suction ring combined at an inner end of the inlet passage of the housing body and guiding fluid through the inlet passage into the impeller.

In the circulating pump with a sub-impeller according to the present invention as above, when impeller rotates, fluid pressure in the impeller chamber becomes higher than that in the inlet passage and thereby the impeller is forced toward the suction ring. Accordingly the impeller rises toward the suction ring while rotating. The impeller is supported by a fluid film formed between an upper surface of the annular flange of the shroud and a lower surface of the flange of the suction ring in the form of a fluid bearing, thus the impeller can rotate lubricatively without contacting the suction ring.

At the same time, when the motor drives and the impeller rotates, the sub-impeller disposed below the impeller rotates accordingly. The sub-impeller forces out pressurized fluid that has flowed below the impeller back from below the impeller radially while rotating. Accordingly, fluid pressure below the impeller becomes lower than that in the other portion of the impeller chamber, thus the pressure difference between the impeller chamber and the inside of the impeller which makes the impeller rise toward the suction ring is reduced.

At this time, a substance such as mud contained in fluid flowing below the impeller is forced out back from below the impeller radially together with fluid by rotation of the sub-impeller. Especially if the substance contained in the flowing pressurized fluid is relatively heavier than the fluid, the substance contained in the fluid is affected by a more powerful centrifugal force than the fluid itself and therefore can be discharged further from the center of the impeller than the fluid.

Therefore, according to the circulating pump with a sub-impeller constructed as above, since pressure difference between the impeller chamber and the inside of the impeller is reduced by the rotation of the sub-impeller, power loss of the motor caused by the pressure difference can be reduced and accordingly the pump efficiency can be prevented from being lowered.

Also, according to the circulating pump with a sub-impeller constructed as above, since the rotation of the sub-impeller keeps a substance such as mud from entering the stator can through a gap between the motor shaft and the upper bush bearing, the substance that has entered the stator can can be prevented from letting a pump efficiency decline.

BRIEF DESCRIPTION OF THE DRAWINGS

Embodiments will describe the present invention in detail with reference to the accompanying drawings in which.

DESCRIPTION OF THE PREFERRED EMBODIMENT

Figure 1:
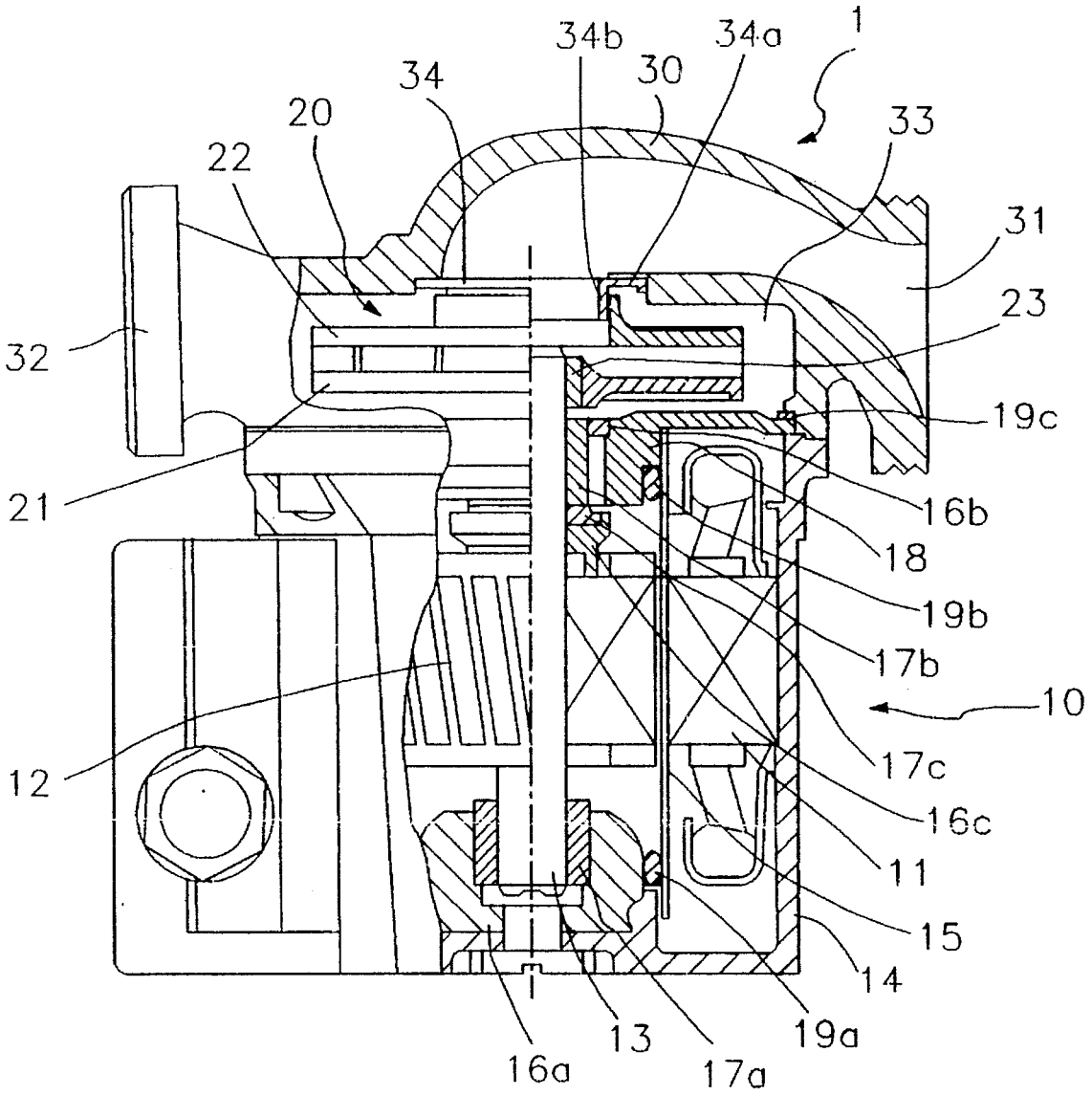
FIG. 1 PRIOR ART
FIG. 1 is a front view, partly in section, showing a first embodiment of the prior-art circulating pump.
Figure 2:
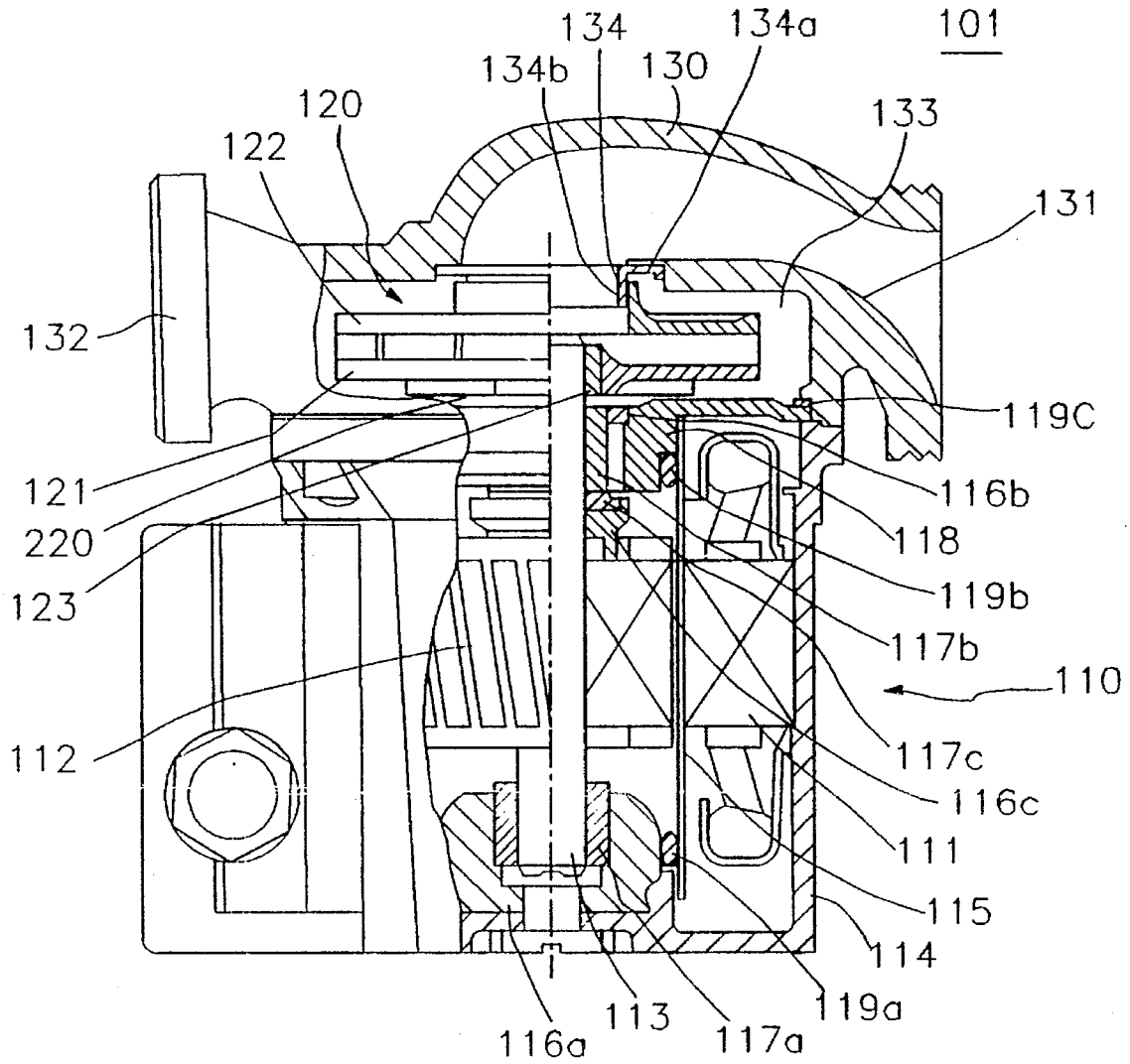
FIG. 2 is a front view, partly in section, showing a first embodiment of a circulating pump with a sub-impeller according to the present invention.
Figure 3:
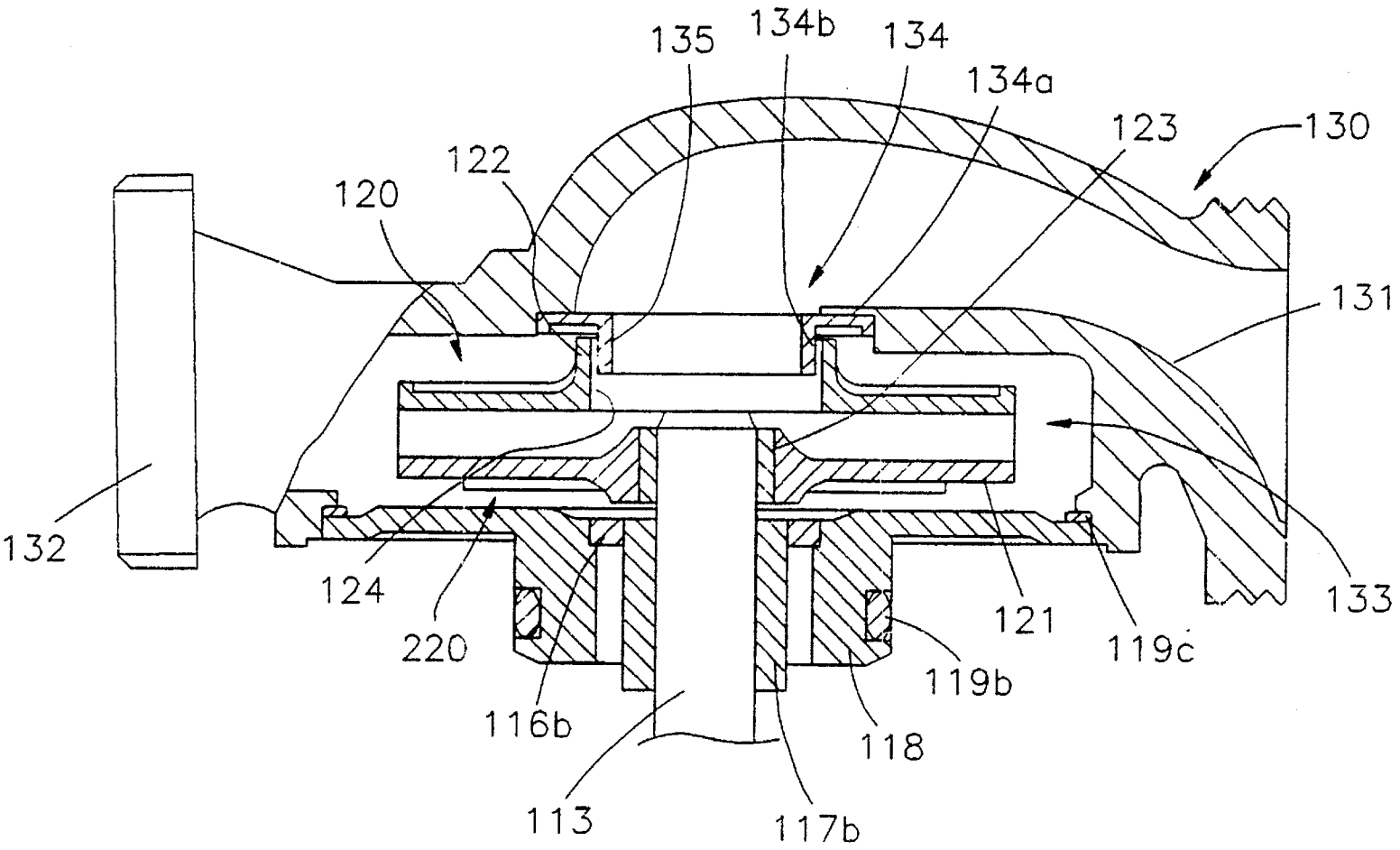
FIG. 3 is a partly enlarged view showing a dispositional relationship of an impeller and a pump housing as shown in FIG. 2.
Figure 4:
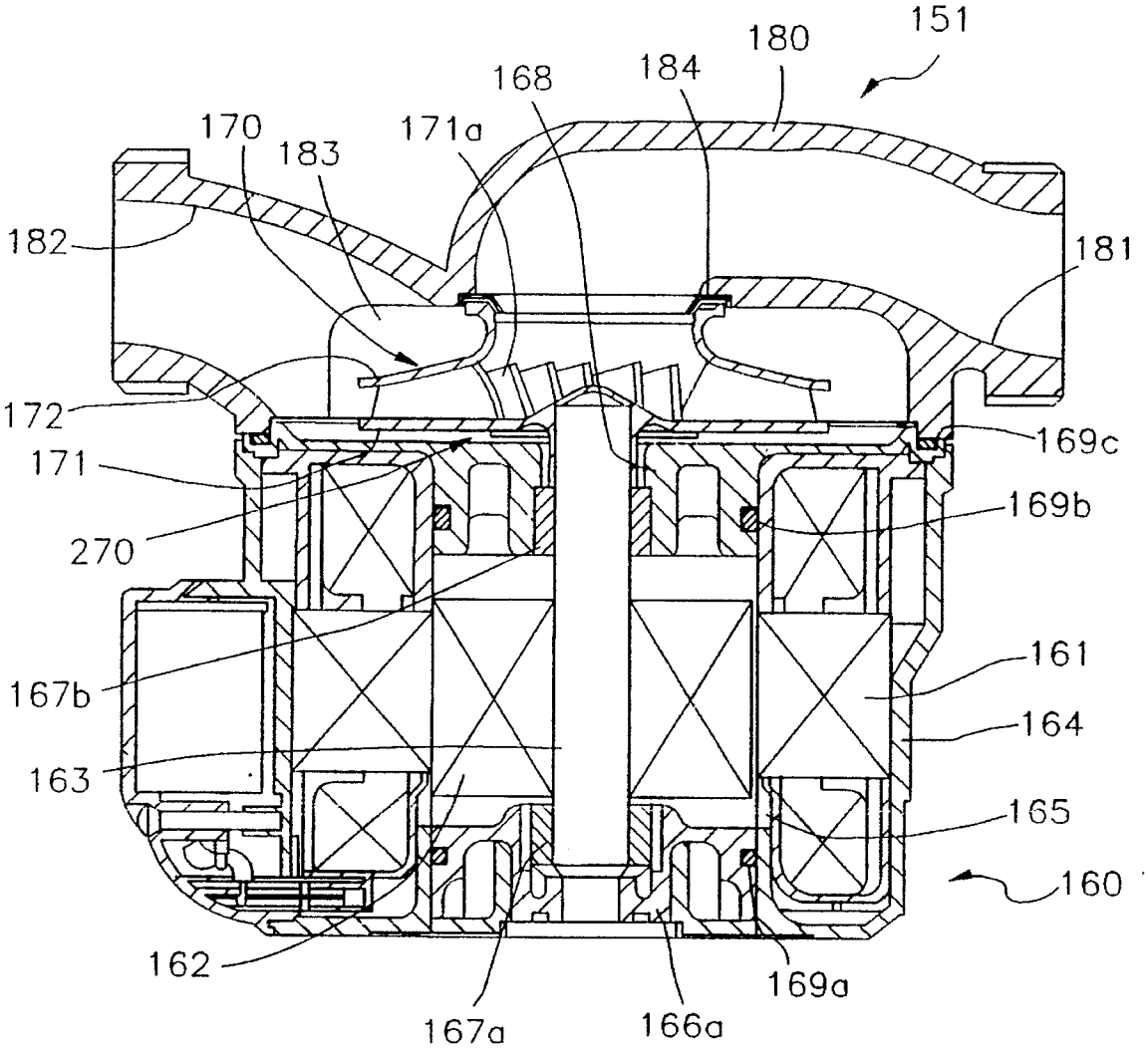
FIG. 4 is a front view, partly in section, showing a second embodiment of a circulating pump with a sub-impeller according to the present invention.
Figure 5:
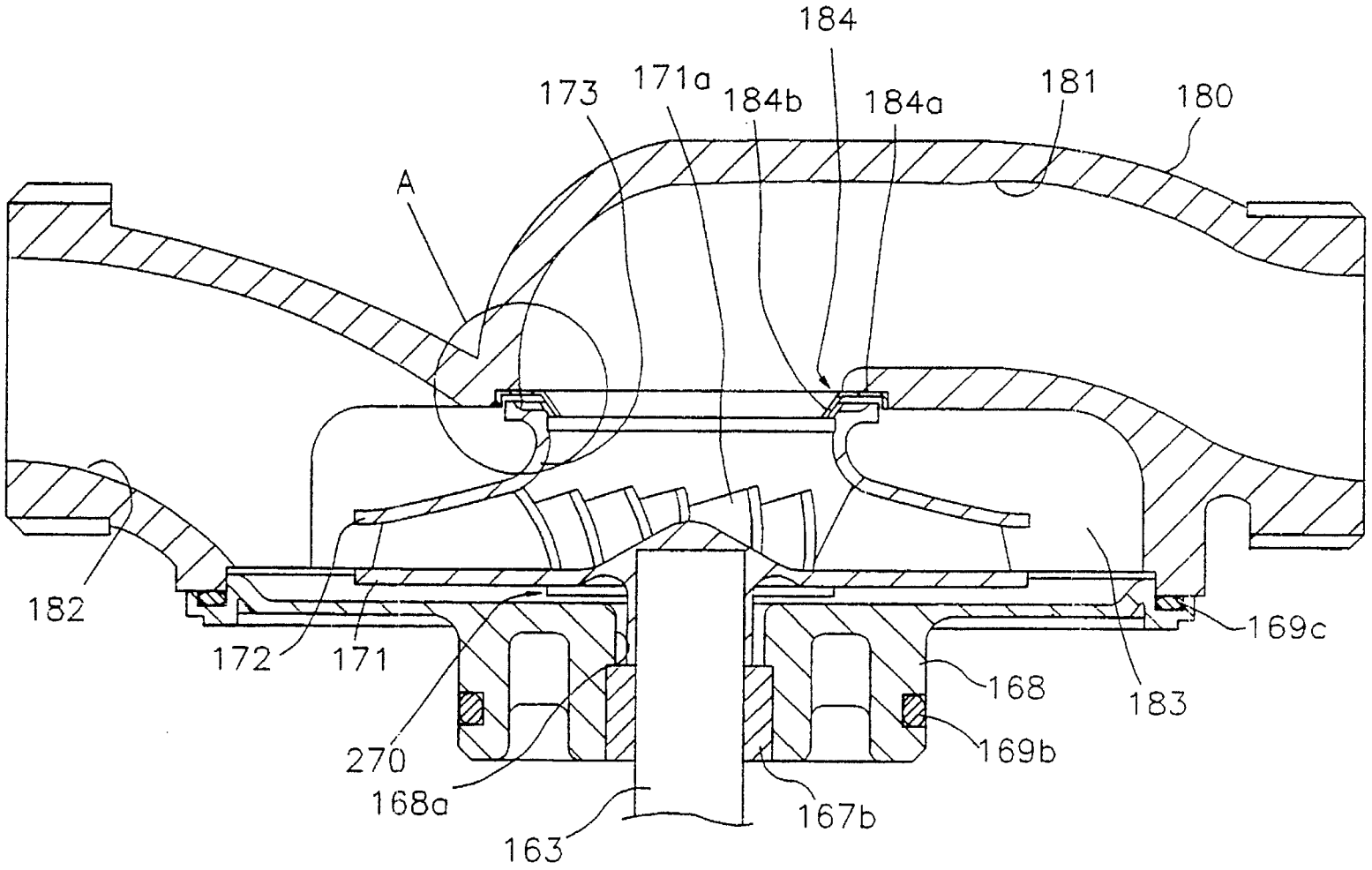
FIG. 5 is a partly enlarged view showing a dispositional relationship of an impeller and a pump housing as shown in FIG. 4.
Figure 6:
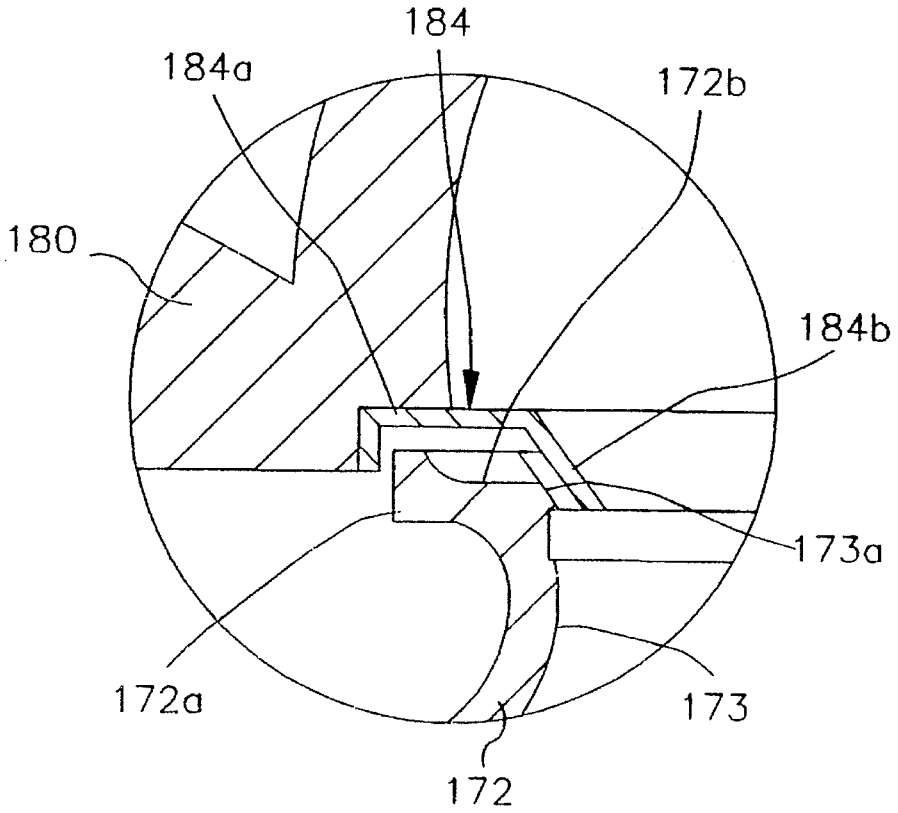
FIG. 6 is a partly enlarged view showing a portion of "A" in FIG. 5.
Figure 7:
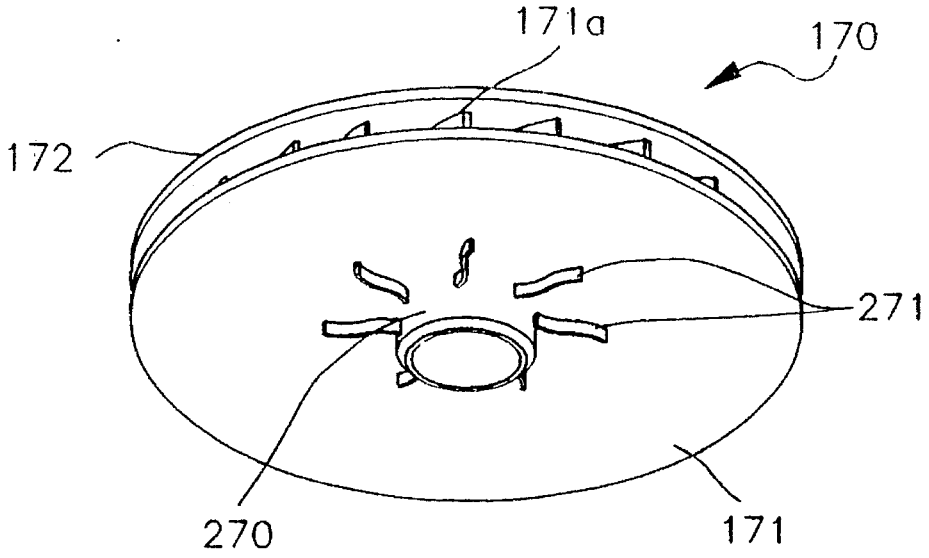
FIG. 7 is a perspective view showing the sub-impeller of the circulating pump with the sub-impeller according to the present invention.

FIGS. 2 and 3 illustrate a first embodiment of a circulating pump with a sub-impeller according to the present invention.

According to FIGS. 2 and 3, a circulating pump with a sub-impeller according to the present invention comprises a motor 110, an impeller 120 and a pump housing 130.

Motor 110 includes a stator 111, rotor 112 and a motor shaft 113. Stator 111 is fixed inside a motor housing 114. Rotor 112 is fixedly assembled with motor shaft 113 and separated from stator 111 by a stator can 115. One end of motor shaft 113 is supported by a lower bearing holder 116*a* and a lower bush bearing 117*a* at the inner bottom of motor housing 114. The other end of mother shaft 113 passes through a motor end shield 118 and is supported by an upper bearing holder 116*b* and an upper bush bearing 117*b* at motor end shield 118. Motor shaft 113 is supported by a trust bearing 117*c* which is to keep the motor shaft 113 from rising in an axial direction of the motor shaft 113. Between lower bearing holder 116*a* and stator can 115, an O-ring 119*a* is provided to prevent fluid from leaking out. Likewise, an O-ring 119*b* prohibits the leakage of fluid between motor end shield 118 and stator can 115.

Impeller 120 includes an impeller body 121 and a shroud 122. Impeller body 121 and shroud 122 are connected to each other by an ultrasonic welding. Impeller body 121 has a plurality of blades for pressurizing fluid and is tightly fitted at the other end of motor shaft 113 by a bush 123. A sub-impeller 220 with a plurality of blades 221 is radially disposed below impeller body 121.

Pump housing 130 is disposed onto motor 110. Pump housing 130 includes an inlet passage 131 and an outlet passage 132 at its right and left sides respectively and an impeller chamber 133 at the center thereof. Impeller 120 is disposed inside impeller chamber 133. A suction ring 134 with a flange 134*a* and a cylinder 134*b* is provided at one end of inlet passage 131 of pump housing 130 just above shroud 122 of impeller 120. A fluid guide hole 135 is formed at the center of suction ring 134. Cylinder 134*b* of suction ring 134 protrudes with a predetermined length into through hole 124 formed at the center of shroud 122 of impeller 120. An O-ring 119*c* is provided to prevent fluid from leaking out between pump housing 130 and motor end shield 118.

In the circulating pump with the sub-impeller 101 according to the present invention constructed as above, when an electric current is applied to stator 111 of motor 110, motor shaft 113 which is rotatably supported against motor housing 114 by means of lower bush bearing 117*a* and upper bush bearing 117*b* rotates by an electromagnetic force occurring between stator 111 and rotor 112. When impeller 120 rotates, the fluid that has flowed into impeller 120 through inlet passage 131 and suction ring 134 of pump housing 130 is pressurized by impeller 120 and is delivered into impeller chamber 133 and subsequently to outlet passage 132.

At the same time, when motor 110 drives and impeller 120 rotates, sub-impeller 220 disposed below impeller 120 rotates accordingly. Sub-impeller 220 forces out pressurized fluid that has flowed below impeller 120 back from below impeller 120 radially while rotating. Accordingly, fluid pressure below impeller 120 becomes lower than that in the other portion of impeller chamber 133, thus the pressure difference between impeller chamber 133 and the inside of impeller 120 which makes impeller 120 rise toward suction ring 134 is reduced.

At this time, a substance such as mud contained in fluid flowing below impeller 120 is forced out from below impeller 120 radially together with fluid by rotation of sub-impeller 220. Especially if the substance contained in the flowing pressurized fluid is relatively heavier than the fluid, the substance contained in the fluid is affected by a more powerful centrifugal force than the fluid itself and therefore can be discharged further from the center of impeller 120 than the fluid.

Therefore, according to the circulating pump with the sub-impeller 101 constructed as above, since pressure difference between impeller chamber 133 and the inside of impeller 120 is reduced by the rotation of sub-impeller 220, power loss of motor 110 caused by the pressure difference can be reduced and accordingly the pump efficiency can be prevented from being lowered.

Also, according to the circulating pump with the sub-impeller 101 constructed as above, since the rotation of sub-impeller 220 keeps a substance such as mud from entering stator can 115 through a gap between motor shaft 113 and upper bush bearing 117*b*, the substance that has entered stator can 115 can be prevented from letting a pump efficiency decline.

FIGS. 4–7 illustrate a second embodiment of a circulating pump with a sub-impeller according to the present invention.

According to FIGS. 4–7, a circulating pump with a sub-impeller according to the present invention comprises a motor 160, an impeller 170 and a pump housing 180.

Motor 160 includes a motor housing 164. A stator 161 is fixed inside motor housing 164. Stator 161 is separated from fluid by a stator can 165, a motor end shield 168 and a plurality of sealing members 169*a*, 169*b* and 169*c*. Rotor 162 is fixedly assembled with a motor shaft 163. One end of motor shaft 163 is supported rotatably and slidably in an axial direction of motor shaft 163 by a lower bearing holder 166*a* and a lower bush bearing 167*a* at the inner bottom of motor housing 164. The other end of motor shaft 163 passes through a through hole 168*a* formed at a motor end shield 168 and is supported rotatably and slidably in the axial direction by an upper bush bearing 167*b* at motor end shield 168. Between lower bearing holder 166*a* and stator can 165, a sealing member 169*a* prohibits fluid from leaking out. Likewise, a sealing member 169*b* prohibits fluid from leaking out between motor end shield 168 and stator can 165.

Impeller 170 includes an impeller body 171 and a shroud 172. Impeller body 171 and shroud 172 are connected to each other by an ultrasonic welding. Impeller body 171 has a plurality of blades 171*a* for pressurizing fluid and is tightly fitted at the other end of motor shaft 163. A sub-impeller 270 with a plurality of blades 271 is radially disposed below impeller body 171. One end of shroud 172 is tightly fixed onto impeller body 171, and at the center thereof a through hole 173 is formed. An inclined surface 173*a* is formed at an upper edge portion of through hole 173. At the other end of shroud 172, there is provided an annular flange 172*a* with a plurality of grooves 172*b* thereon.

Pump housing 180 is disposed onto motor 160. Pump housing 180 includes an inlet passage 181 and an outlet passage 182 provided at both sides thereof respectively and an impeller chamber 183 formed at the center thereof. Impeller 170 is disposed inside impeller chamber 183. Impeller chamber 183 is communicated with an inlet passage 181 and an outlet passage 182 respectively. A suction ring 184 is provided at one end of inlet passage 181. Suction ring 184 includes a flange 184*a* and an inclined guiding portion 184*b* with the same angle with inclined surface 173*a* of shroud 172. Between pump housing 180 and motor end shield 168 a sealing member 169*c* is provided to prevent fluid from leaking out.

According to the circulating pump with the sub-impeller 151 according to the present invention constructed as above, when an electric current is applied to stator 161 of motor 160, motor shaft 163 which is rotatably supported against motor housing 164 by means of lower bush bearing 167*a* and upper bush bearing 167*b* rotates by, an electric magnetic force occurring between stator 161 and rotor 162. Accordingly, impeller 170 which is tightly fitted at one end of motor shaft 163 rotates. When impeller 170 rotates, fluid flows into an inside of impeller 170 through inlet passage 181 and suction ring 184 of pump housing 180. The fluid is pressurized by impeller 170 and is delivered into impeller chamber 183 and subsequently to outlet passage 182. When impeller 170 rotates, fluid that has flowed through inlet passage 181 thereinto is pressurized into impeller chamber 183 by a plurality of blades 171*a* of impeller 170, accordingly fluid pressure in impeller chamber 183 is higher than that in the inside of impeller 181. Accordingly, impeller 170 is forced toward suction ring 184. Meanwhile, since motor shaft 163 at which impeller 170 is fixed is supported against motor housing 164 rotatably and slidably in the axial direction by lower bush bearing 167*a* and upper bush bearing 167*b*, impeller 170 axially rises toward suction ring 184 while rotating.

Further, since the fluid pressure in impeller chamber 183 is higher than that in the inside of impeller 170, the pressurized fluid in impeller chamber 183 is reversed to flow to inlet passage 181 through the clearance between the upper side of annular flange 172*a* of shroud 172 and the lower side of flange 184*a* of suction ring 184 and between inclined surface 173*a* of shroud 172 and inclined guiding portion 124*b* of suction ring 184. At this time, the fluid that has flowed into the clearance between the upper side of annular flange 172*a* of shroud 172 and the lower side of flange 184*a* of suction ring 184 is affected by a centrifugal force going back toward the outside of annular flange 172*a* by a plurality of grooves 172*b* on annular flange 172*a*. Fluid that has flowed into the clearance and fluid pressurized outward by grooves 172*b* conflict with each other around outer ends of grooves 172*b*. This fluid confliction makes a fluid film with considerable pressure between shroud 172 and suction ring 184. The fluid film serves as a fluid bearing for supporting impeller 170 so that impeller 170 can rotate lubricatively without contacting suction ring 184.

At the same time, when impeller 170 rotates, sub-impeller 270 disposed below impeller 170 rotates accordingly. Sub-impeller 270 forces out pressurized fluid that has flowed below impeller 170 back from below impeller 170 radially while rotating. Accordingly, fluid pressure below impeller 170 becomes lower than that in the other portion of impeller chamber 183, thus the pressure difference between impeller chamber 183 and the inside of impeller 170 which makes impeller 170 rise toward suction ring 184 is reduced.

At this time, a substance such as mud contained in fluid flowing below impeller 170 is forced out back from below impeller 170 radially together with fluid by rotation of sub-impeller 270. Especially if the substance contained in the flowing pressurized fluid is relatively heavier than the fluid, the substance contained in the fluid is affected by a more powerful centrifugal force than the fluid itself and therefore can be discharged further from the center of impeller 170 than the fluid.

Therefore, according to the circulating pump with the sub-impeller 151 constructed as above, since pressure difference between impeller chamber 183 and the inside of impeller 170 is reduced by the rotation of sub-impeller 270, power loss of motor 160 caused by the pressure difference is reduced and accordingly the pump efficiency can be prevented from being lowered.

Also, according to the circulating pump with the sub-impeller 151 constructed as above, since the rotation of sub-impeller 270 keeps a substance such as mud from entering stator can 165 through a gap between motor shaft 163 and upper bush bearing 167*b*, the substance that has entered stator can 165 can be prevented from letting a pump efficiency decline.

It should be obvious to people skilled in the art that modifications can be made to the invention described above without departing from the spirit or the scope of the invention.

What is claimed is:

1. A circulating pump with a sub-impeller comprising:

a motor including a motor housing, a stator fixed inside the motor housing, a stator can, a motor end shield and a plurality of sealing members for separating the stator from fluid, a rotor rotated by means of an electromagnetic interaction with the stator when an electric current is applied to the stator, and a motor shaft integrally combined with the rotor, one end of the motor shaft being supported rotatably by a lower bush bearing at the inner bottom of the motor housing, the other end of the motor shaft being projected passing through a through hole formed in the motor end shield, and the motor shaft being supported rotatably by an upper bush bearing at the through hole of the motor end shield;

an impeller including an impeller body having a plurality of blades for pressurizing fluid, in which the impeller body is fixedly assembled with the other end of the motor shaft, a sub-impeller with a plurality of blades radially disposed below the impeller body, and a shroud integrally fixed onto the impeller body, at the center of the shroud a through hole being formed for allowing fluid to flow and at the other end of the shroud an annular flange with a plurality of grooves being formed; and a pump housing including a housing body disposed onto the motor and comprising an inlet passage and an outlet passage, at the center of the housing body the impeller being disposed and an impeller chamber being communicated with the inlet passage and the outlet passage, and a suction ring combined at an inner end of the inlet passage of the housing body, in which the suction ring guides fluid through the inlet passage into the impeller.

* * * * *